United States Patent [19]

Iida et al.

[11] Patent Number: 4,520,294

[45] Date of Patent: May 28, 1985

[54] HIGH PRESSURE METAL VAPOR DISCHARGE LAMP

[75] Inventors: Takenobu Iida, Urawa; Shunichi Sasaki, Tokyo, both of Japan

[73] Assignee: Iwasaki Electric Co., Ltd., Tokyo, Japan

[21] Appl. No.: 522,344

[22] Filed: Aug. 11, 1983

[30] Foreign Application Priority Data

Aug. 23, 1982 [JP] Japan ..... 57-144795

[51] Int. Cl.[3] ..... H01J 7/44

[52] U.S. Cl. ..... 315/50; 315/59; 315/72; 315/290

[58] Field of Search ..... 315/58, 59, 289, 290, 315/243, 244, 104, 50, 71, 72

[56] References Cited

U.S. PATENT DOCUMENTS

| | | | |
|---|---|---|---|
| 4,117,370 | 9/1978 | Jacobs et al. | 315/35 |
| 4,277,725 | 7/1981 | Sneijers | 315/72 |
| 4,337,417 | 7/1982 | Johnson | 315/290 |
| 4,399,390 | 8/1983 | Oshita et al. | 315/101 |
| 4,473,778 | 9/1984 | Adachi | 315/290 |

*Primary Examiner*—Harold Dixon

*Attorney, Agent, or Firm*—Shapiro and Shapiro

[57] ABSTRACT

There is disclosed a high pressure metal vapor discharge lamp which contains in an outer bulb a starting circuit connected in parallel with a light emitting tube having at least one pair of main electrodes. The starting circuit includes a ceramic capacitor surrounded by glass material and exhibiting a non-linear voltage-charge characteristic.

28 Claims, 13 Drawing Figures

HIGH PRESSURE METAL VAPOR DISCHARGE LAMP

BACKGROUND OF THE INVENTION

1. Field of the Invention

The present invention relates to an improvement of a high pressure metal vapor discharge lamp such as a metal halide lamp or a high pressure sodium lamp, and more particularly to an improvement of a high pressure metal vapor discharge lamp which contains a starting circuit to facilitate start.

2. Description of the Prior Art

In general, the high pressure metal vapor discharge lamp such as the metal halide lamp or the high pressure sodium lamp has a high starting voltage and it is difficult to start such a discharge lamp with a conventional commercial power supply. Recently, it has been proposed to incorporate a starting circuit in the lamp to generate a high voltage pulse, which is then applied to a light emitting tube together with a power supply voltage to facilitate the start. Such a discharge lamp does not use a large size separate stabilizer having a high secondary non-load voltage, does not incorporate a starter in a stabilizer, or does not use a separate starter externally of the stabilizer and it can be used by merely connecting it to an existing high pressure mercury lamp stabilizer. Accordingly, it is very convenient to use and a demand therefor has been rapidly increasing.

Most popular one of such high pressure metal vapor discharge lamps having self-contained starting circuit is shown in FIG. 1, in which a starting circuit 4 having a serial connection of a thermo-sensitive switch 2 which is closed at a room or normal temperature (when the lamp is off) and open at a high temperature (when the lamp is on) and a resistor 3 is connected in parallel with a light emitting tube 1 having at least a pair of main electrodes and accommodated in an external bulb 5 and connected to an AC power supply 7 through an inductive stabilizer 6. As will be discussed later, the thermo-sensitive switch 2 functions to switch on and off a current flowing in the starting circuit 4 to generate high voltage pulses to start the discharge lamp, and after the discharge lamp has been started, it blocks the starting circuit 4 from the AC power supply 7. Usually, it is a bimetal switch. The resistor 3 connected in series with the thermo-sensitive switch 2 functions to limit the current flowing in the starting circuit 4 to an appropriate magnitude, and once the discharge has occurred across the main electrodes of the light emitting tube 1 by the function of the starting circuit 4, it functions to prevent extinction of the discharge even if the thermo-sensitive switch 2 is again closed. Usually, it is a heat generating element such as an incandescent filament.

In this discharge lamp, when the AC power supply 7 is turned on, the current flows into the starting circuit 4 and the resistor 3 generates a heat. As a result, the thermo-sensitive switch 2 is opened. As a result, the current to the starting circuit 4 is cut off and the resistor 3 stops to generate the heat. Thus, the thermo-sensitive switch 2 is closed and the current again flows into the starting circuit 4 and the thermo-sensitive switch 2 is opened again. In this manner, the thermo-sensitive switch 2 repeats the on-off operation and the current in the starting circuit 4 is turned on and off. As a result, high voltage pulses are generated across the stabilizer 6. Since the high voltage pulses are applied to the main electrodes of the light emitting tube 1 together with the power supply voltage, the light emitting tube 1 is fired. After the discharge lamp has been started, the thermo-sensitive switch 2 is kept open by the heat generated by the light emitting tube 1 and the generation of the high voltage pulses is stopped.

The starting circuit used in this discharge lamp is a simple circuit comprising a serial connection of the thermo-sensitive switch such as bimetal switch and the resistor such as incandescent filament. Since it is economic and can withstand the use in a high temperature environment, it has been widely used as the starting circuit contained in the high pressure metal vapor discharge lamp.

However, the above starting circuit has the following disadvantages.

First, since the thermo-sensitive switch 2 is usually the mechanical bimetal switch, a certain degree of ununiformity and variance in the switching operation is unavoidable. As a result, a timing and a magnitude of the high voltage pulse are not constant and a starting characteristic is necessarily unstable.

Secondary, due to the fact that the timing and the magnitude of the high voltage pulse are not constant, an unduly high voltage pulse may be generated, which adversely affects to the discharge lamp and the starting circuit. Accordingly, an abnormal pulse absorbing circuit must be provided. FIG. 2 shows a waveform of the high voltage pulse generated by the starting circuit shown in FIG. 1. As seen from FIG. 2, the interval of the generation of the high voltage pulses and the magnitude of the high voltage pulse are unstable. As to the magnitude of the pulses, a high voltage pulse of 5 KV which is larger than 3–3.5 KV required to start the discharge lamp is generated.

Thirdly, since the resistor 3 of the starting circuit is usually the incandescent filament, the incorporation thereof into the discharge lamp and the anti-vibration means therefor need special techniques.

In order to resolve the above disadvantages, it has been proposed to replace the component of the starting circuit, for example, the thermo-sensitive switch with a voltage-sensitive semiconductor switching device which has no mechanical switching element so that the components of the starting circuit are constructed by semiconductor devices or electronic devices as much as possible.

However, when such semiconductor devices or electronic devices are to be incorporated in the high pressure metal vapor discharge lamp, significant technical problems are encountered. First, since the high pressure metal vapor discharge lamp reaches to a very high temperature during the discharge as opposed to a low pressure metal vapor discharge lamp such as a fluorescent lamp (for example, a temperature in an external bulb of a 400 W high pressure sodium lamp mounted in a lamp case reaches to approximately 400° C. during the discharge), the components incorporated in the discharge lamp cannot maintain the intended functions and are degradated and made unusable in a short period.

In order to start the high pressure metal vapor discharge lamp, a high voltage pulse which is higher in magnitude and larger in energy than that required to start the fluorescent lamp is necessary. When the components which can generate such high voltage pulses under a normal condition and meet the temperature requirement described above are to be used, the sizes of the components necessarily increase and the incorporation thereof into the discharge lamp is difficult to attain.

By those reasons, the high pressure metal vapor discharge lamp which contains the starting circuit constructed by the semiconductor devices or the electronic devices has not been put into practice although it may be good from a theoretical standpoint.

SUMMARY OF THE INVENTION

The present invention is intended to resolve the above difficulties. In accordance with the present invention, a main portion of the starting circuit is constructed by the semiconductor devices or the electronic devices to stabilize the starting characteristic, to eliminate the abnormal pulse absorbing circuit, to facilitate the assembling and to improve the anti-vibration property, and the construction of the components of the starting circuit and a method for incorporating it are improved to provide a practical high pressure metal vapor discharge lamp which contains the starting circuit which can withstand the use in a high temperature environment and is compact as a whole.

DETAILED DESCRIPTION OF THE PREFERRED EMBODIMENTS

Figure 3:
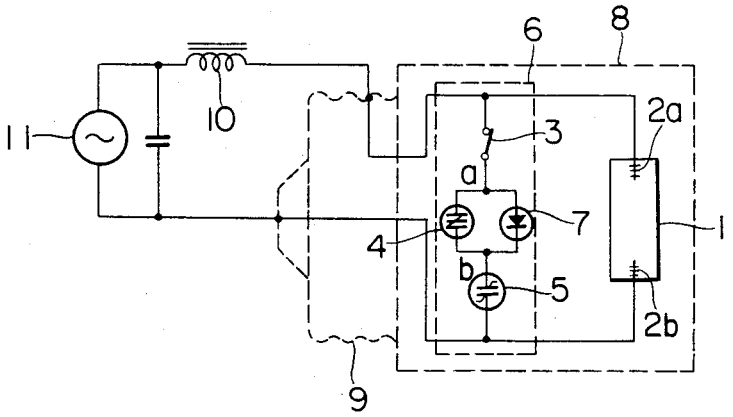
FIG. 3 shows a circuit diagram of one embodiment of a high pressure metal vapor discharge lamp of the present invention.

FIG. 3 shows a basic circuit configuration of a high pressure metal vapor discharge lamp in accordance with the present invention. Numeral 1 denotes a light emitting tube having at least one pair of main electrodes 2*a* and 2*b*. The light emitting tube 1 is made of quartz glass or light-transmissive ceramic, and mercury, a starting gas and several appropriate light emitting metals are filled therein. Connected in parallel with the light emitting tube 1 is a starting circuit 6 which comprises a serial connection of at least a thermo-sensitive switch 3 which is closed at a normal temperature (when the lamp is off) and open at a high temperature (when the lamp is on), a voltage-sensitive semiconductor switching device 4 such as a silicon symmetrical switch (SSS) surrounded by a glass material, and a capacitor (hereinafter referred to as a non-linear or ceramic capacitor) having a non-linear voltage-charge characteristic (hysteresis) made of a dielectric (ceramic) material surrounded by a glass material. Numeral 7 denotes a diode surrounded by a glass material, which is connected in parallel to the semiconductor switching device 4. The diode 7 functions to operate the semiconductor switching device 4 at a double voltage of an AC power supply voltage. It is not absolutely necessary as will be explained later. The starting circuit 6 and the light emitting tube 1 are accommodated in an outer bulb 8 which has an appropriate amount of inert gas filled therein or is essentially evacuated. Numeral 9 denotes a base fixed at one end of the external bulb 8. The light emitting tube 1 and the starting circuit 6 are connected to an AC power supply 11 through the base 9 and an inductive stabilizer 10.

Figure 4:
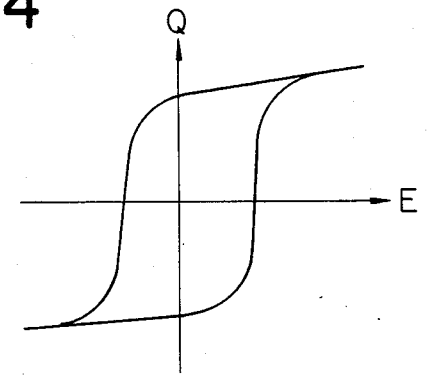
FIG. 4 shows a voltage-charge characteristic of a non-linear capacitor used in a starting circuit of the discharge lamp of the present invention.

The ceramic capacitor 5 of the starting circuit 6 is essentially made of barium titanate ($BuTiO_3$) and, in general, it exhibits a non-linear voltage (E)—charge (Q) characteristic (hysteresis) as shown in FIG. 4. In the present embodiment, in order to shift a Curier point (and a second transition point) such that a specific dielectric constant $\epsilon_s$ of the capacitor is 5,000–20,000 in a temperature range of −30° C.–+60° C. which is a surrounding temperature at which the discharge lamp is normally started, barium zirconate ($BaZrO_3$) with strontium titanate ($SrTiO_3$) being added to improve a sintering property, or without the addition of strontium titanate, is added to the barium titanate by the amount of 10–30 mole by percent.

It is preferable to add calcium titanate ($CaTiO_3$) by the amount of several mole by percent in order to prevent abrupt change of the specific dielectric constant in a vicinity of the Curier point. The mixture is formed into a thin plate by a conventional powder pressing method and it is fired in air at a temperature of 1300° C.–1400° C. at maximum for about two hours. Then, silver film electrodes are applied to the fired thin plate by baking at 700° C.–800° C. and lead wires are attached thereto by silver-soldering. Finally, the entire outer surfaces are overcoated with a glass material such as low melting point glass or high dielectric glass. The over coat functions to prevent the deterioration of a breakdown voltage characteristic due to the fact that oxygen in the barium titanate dissociates by a high temperature during the operation of the discharge lamp and the barium titanate is semiconductorized because the outer bulb 8 of the discharge lamp is usually evacuated or filled with the inert gas, and also serves to prevent the sublimation of the silver film electrodes. It is essential when the capacitor is incorporated in the outer bulb, as is done in the present invention.

The semiconductor switching device 4 of the starting circuit 6 has a silicon PNPN or PNPNP junction and an element thereof is passivated with glass and an outer surfaces thereof are molded with glass. Such a silicon junction can withstand the use at a temperature of 400° C.–500° C. for a substantially long period so long as it is not oxidized. Accordingly, it can be incorporated in the discharge lamp without problem.

The diode 7 which is connected in parallel to the semiconductor switching device 4 as required has an element thereof passivated with glass and molded with glass. Such a diode is commercially available by under a model number of V06G. However, since such a commercially available diode has copper lead wires soldered with tin-lead solder, the tin-lead solder should be removed because it is evaporated at a high temperature.

Since the semiconductor switching device 4 and the diode 7 are accommodated in the external bulb 8 which is usually evacuated or filled with the inert gas, the elements thereof are not oxidized should the glass passivation be broken during the operation of the semiconductor device by thermal impact or other causes.

In the present invention, as described above, the outer surfaces of the ceramic capacitor 5 of the starting circuit 6 are surrounded by the glass material to improve the heat resistivity of the capacitor and prevent the degradation of the function of the capacitor due to the fact that the oxygen in the high dielectric ceramic material of the capacitor such as the barium titanate dissociates at the high temperature.

The outer surfaces of the semiconductor switching device 4 and the diode 7 are also surrounded by the glass materials to improve the heat resistivity and prevent the oxdization of the elements in case the leakage occurs.

However, a practical starting circuit to be incorporated in the discharge lamp cannot yet be provided with those means only. For example, when the serial circuit of the ceramic capacitor 5 and the semiconductor switching device 4 is connected in parallel to the light emitting tube 1 and they are accommodated in the outer bulb 8 and if the semiconductor switching device 4 is placed in a high temperature environment during the operation of the discharge lamp, a breakover voltage of the semiconductor switching device 4 falls and the semiconductor switching device 4 cannot function as a switching device, and if a current continuously flows into the starting circuit, the element of the semiconductor switching device 4 is broken.

Figure 1:
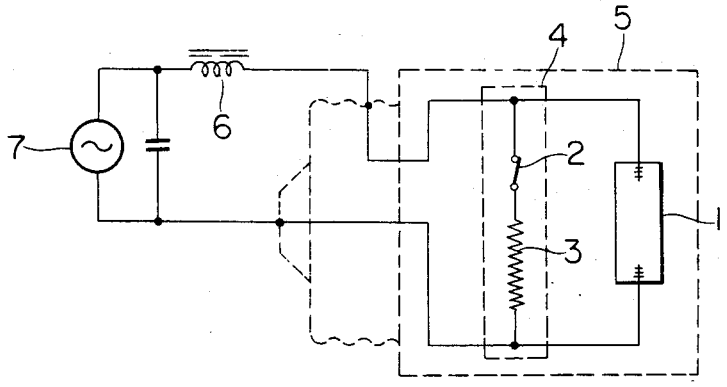
FIG. 1 shows a circuit diagram of a prior art high pressure metal vapor discharge lamp which self-contains a starting circuit.
Figure 2:
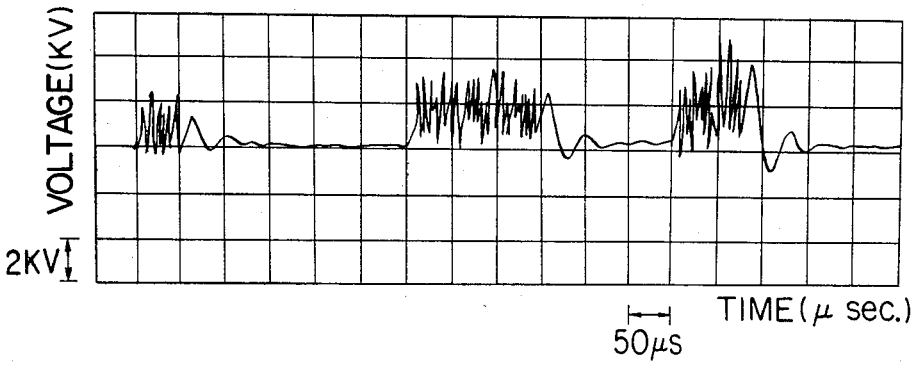
FIG. 2 shows a waveform of a high voltage pulse generated by the starting circuit of the discharge lamp of FIG. 1.

In the present invention, the thermo-sensitive switch 3 which is closed at the room temperature (when the lamp is off) and open at the high temperature (when the lamp is on) is connected in series with the semiconductor switching device 4. It should be noted that the thermo-sensitive switch 3 is essentially different from that of the prior art discharge lamp shown in FIG. 1 in that it does not directly serve to generate the high voltage pulses.

Figure 5:
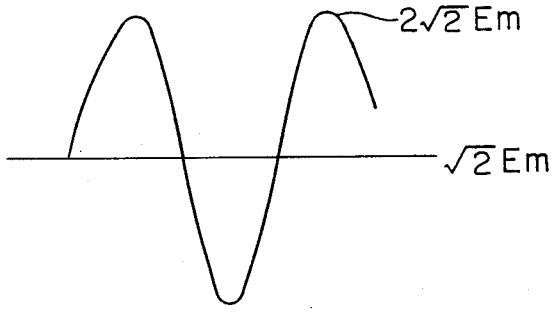
FIGS. 5 and 6 show voltage waveforms at start time of the discharge lamp of the present invention.
Figure 6:
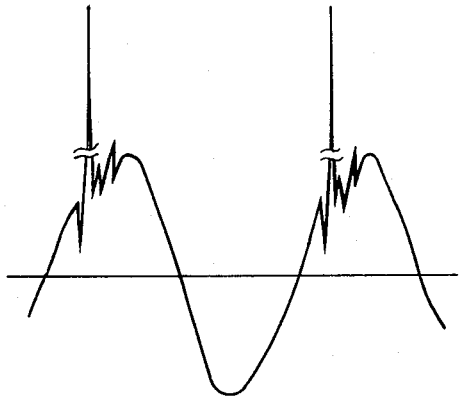

The operation of the discharge lamp is now explained. The commercial AC power supply 11 of 200 V–240 V and 50 Hz/60 Hz is applied through the stabilizer 10. The voltage is applied to the serial circuit of the parallel circuit of the semiconductor switching device 4 and the diode 7, and the ceramic capacitor 5, through the thermo-sensitive switch 3 which is closed or ON at the room temperature. The ceramic capacitor 5 is charged by this voltage in a half cycle of the AC power supply voltage. In the next half cycle, the charge in the ceramic capacitor 5 is superimposed on the power supply voltage so that a voltage shown in FIG. 5 is developed across terminals a and b of the parallel circuit of the semiconductor switching device 4 and the diode 7. A peak value of the voltage relative to the point a is $\sqrt{2}$ Em, where Em is the power supply voltage, or 564 volts when Em is 200 volts. If the breakover voltage of the semiconductor switching device 4 is preset to approximately 480 volts, the semiconductor switching device 4 is turned on when the power supply voltage exceeds the breakdown voltage and the charge of the ceramic capacitor 5 is discharged. A high voltage pulse of approximately 3–3.5K volts which higher than that when a conventional capacitor is used is generated in the stabilizer 10 by the voltage-charge characteristic of the ceramic capacitor 5, and this high voltage pulses are superimposed on the power supply voltage as shown in FIG. 6 and the combined voltage is applied to the main electrodes 2*a* and 2*b* of the light emitting tube 1. As a result, the discharge lamp is started. As the discharge lamp is started, the heat radiation from the light emitting tube 1 increases and the thermo-sensitive switch 3 is opened or turned off to isolate the starting circuit 6 from the power supply 11.

Figure 7:
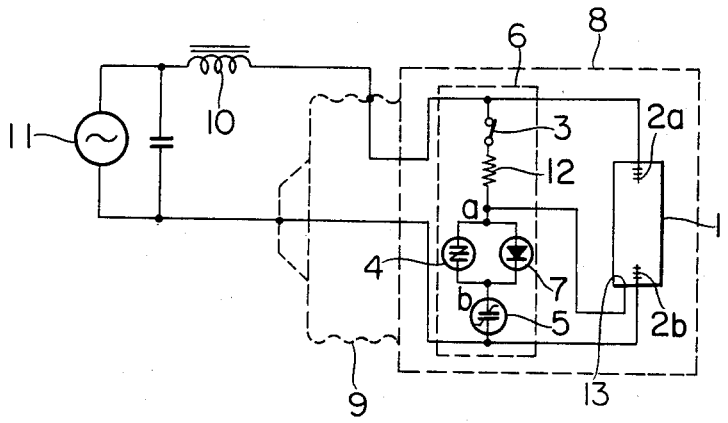
FIGS. 7 to 11 and FIG. 13 show circuit diagrams of other embodiments of the discharge lamp of the present invention.

FIG. 7 shows another embodiment of the present invention, in which a resistor 12 is connected in series with the serial circuit of the thermo-sensitive switch 3, the parallel circuit of the semiconductor switching device 4 and the diode 7, and the ceramic capacitor 5, and an auxiliary electrode 13 is provided in adjacent to the main electrode 2*b* of the light emitting tube 1, and the serial circuit of the parallel circuit of the semiconductor switching device 4 and the diode 7, and the ceramic capacitor 5 is connected across the main electrode 2*b* and the auxiliary electrode 13. The resistor 12 may be a conventional solid resistor and a resistance thereof is properly selected such that a sufficient current to turn on the semiconductor switching device 4 flows therethrough and a high voltage pulse generated is large enough to cause an arc discharge between the main electrodes 2*a* and 2*b* but does not cause an arc discharge between the main electrode 2*b* and the adjacent auxiliary electrode 13.

The connection of the resistor 12 in series with the starting circuit can also be applied to the circuit of FIG. 3 where no auxiliary electrode is provided in the light emitting tube.

Figure 8:
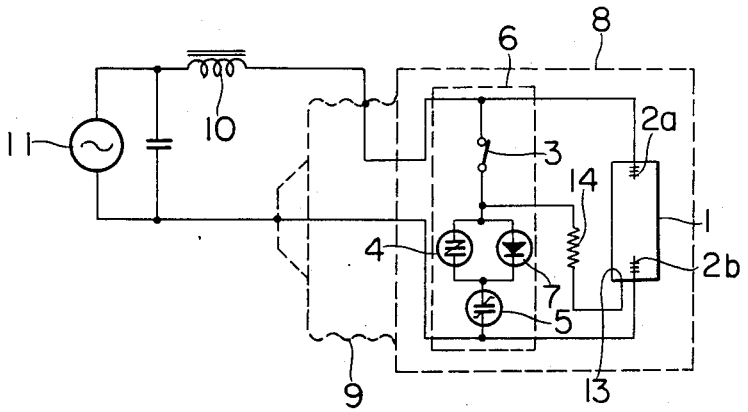

FIG. 8 shows other embodiment of the present invention, in which the serial circuit of the parallel circuit of the semiconductor switching device 4 and the diode 7, and the ceramic capacitor 5 is connected between the main electrode 2*b* of the light emitting tube 1 and the adjacent auxiliary electrode 13 through a starting resistor 14. The circuit of FIG. 8 operates in a similar manner to that of FIG. 7.

The discharge lamps shown in FIGS. 7 and 8 are suitable for use with a metal halide lamp in which mercury, starting gas and several appropriate light emitting metals such as sodium, scandium and thorium, and halogen such as iodine, bromine or chlorine, or compound thereof, are filled in the light emitting tube made of quartz glass.

Figure 9:
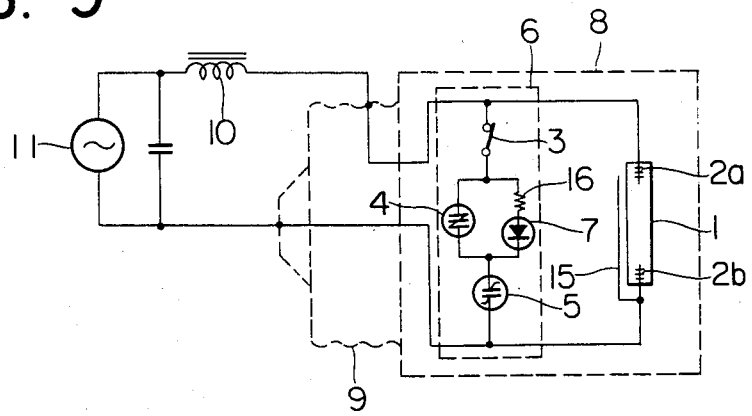

FIG. 9 shows an embodiment of the present invention applied to a high pressure sodium lamp. The light emitting tube 1 is made of light-transmissive ceramic, and an alkaline metal such as sodium, a starting gas such as xenon and a buffering gas source such as mercury are filled in the light emitting tube 1. A proximity conductor 15 for assisting the start is mounted on an outer wall of the light emitting tube 1. The proximity conductor 15 is connected such that it is of the same potential as the one electrode 2*b*.

A counterelectrode potential is applied to the other electrode 2*a*. A resistor 16 is connected in series with the diode 7 to delay the charging of the capacitor 5 so that one high voltage pulse is generated at every second to fourth cycle of the AC power supply voltage. As a result, the high voltage pulse having a high peak is generated and it is suitable to start the high pressure sodium lamp. The resistance of the resistor 16 is properly selected to attain such an appropriate time constant.

Figure 10:
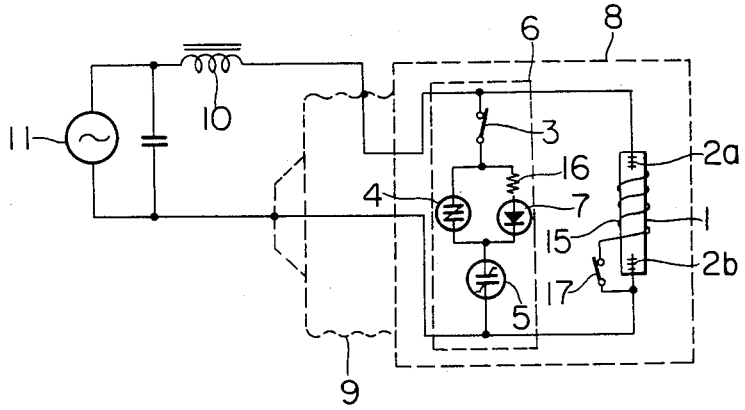

FIG. 10 shows a modification of the discharge lamp shown in FIG. 9. In FIG. 9, if a potential is kept applied to the proximity conductor 15 after the turn-on of the light emitting tube 1, sodium ions in the light emitting tube 1 are attracted by the potential and leak out of the light emitting tube 1. As a result, a characteristic of the discharge lamp is deteriorated. Accordingly, it is advisable to move the proximity conductor away from the outer wall of the light emitting tube by thermo-responsive means after the discharge lamp has been started, or when the proximity conductor 15 is wrapped around the light emitting tube 1 as shown in FIG. 10, the circuit for supplying the potential to the proximity conductor 15 is cut off by a thermo-sensitive switch 17.

Figure 11:
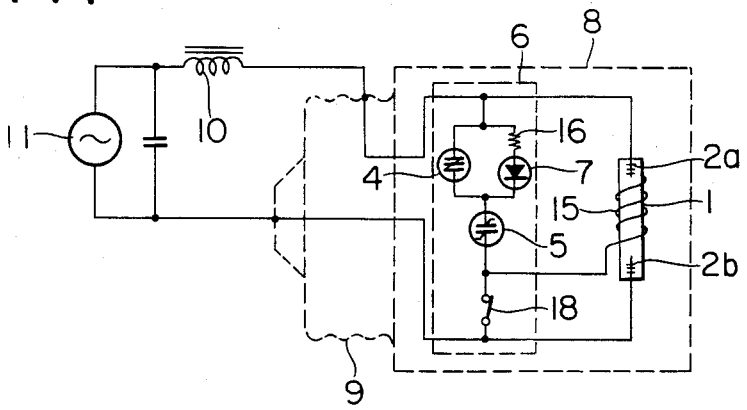

FIG. 11 shows a modification of the discharge lamp shown in FIG. 10. In the discharge lamp shown in FIG. 10 in which the thermo-sensitive switch 17 for the proximity conductor 15 is provided separately from the thermo-sensitive switch 3 for the starting circuit 6, when the lamp is restarted, that is, when the power supply of the lamp is turned off and then turned on immediately thereafter, the thermo-sensitive switch 3 may be closed before the thermo-sensitive switch 17 is closed to supply the potential to the proximity conductor 15. In such a case, the starting circuit 6 operates to generate the high voltage pulses but the lamp may not be started because of a high vapor pressure in the light emitting tube. If the high voltage pulses are continuously generated under this condition, the breakdown voltage of the stabilizer decreases, the electromagnetic wave disturbance occurs due to the generation of high frequency noises, or the ceramic capacitor of the starting circuit is deteriorated by the vibration. In the modification of FIG. 11, means for applying or removing the potential to or from the proximity conductor 15 is shared with or linked to the thermo-sensitive switch 3 for the starting circuit 6 to prevent the starting circuit from being operated until the potential is applied to the proximity conductor 15. This is denoted by reference numeral 18.

Figure 12:
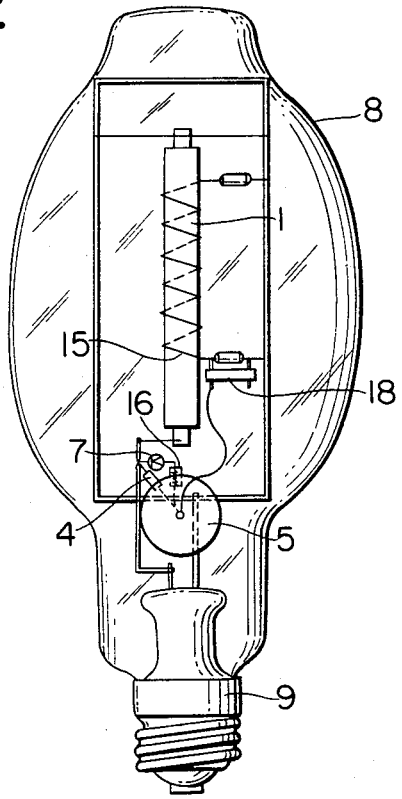
FIG. 12 shows a specific external view of the discharge lamp shown in FIG. 11.

FIG. 12 shows a specific external view of the discharge lamp shown in FIG. 11. The like elements to those shown in FIG. 11 are designated by the like numerals.

Figure 13:
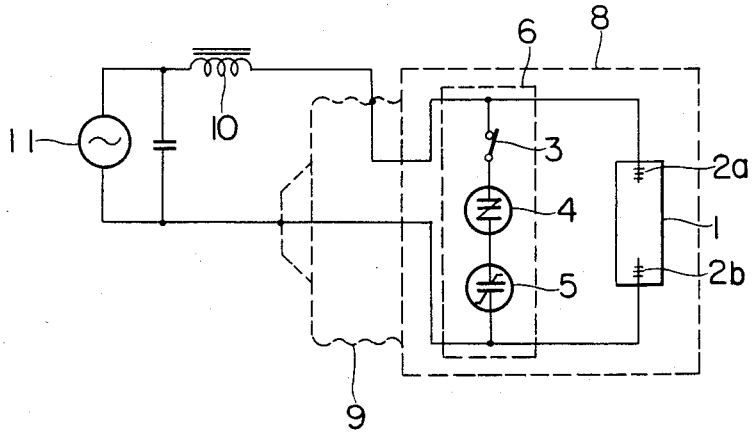

FIG. 13 shows a modification of the discharge lamp shown in FIG. 3, in which the diode 7 connected in parallel to the semiconductor switching device 4 in FIG. 3 is omitted. In the present modification, since the capacitor is not charged by the double voltage of the power supply voltage, the high voltage pulses as shown in FIG. 3 are not generated but it can be used as a starting circuit for a discharge lamp having a relatively low starting voltage.

A specific embodiment of the present invention is now explained. In the present embodiment, the circuit shown in FIG. 11 is applied to a high pressure sodium lamp having a rated power of 360 W. The light emitting tube 1 has an inner diameter of 8 mm and an electrode-to-electrode spacing of 81 mm, and an appropriate amount of sodium amalgam and xenon gas at 150 torr are filled therein. The resistor 16 is a 30KΩ carbon resistor. The semiconductor switching device 4 is a silicon symmetrical switch (SSS) having a PNPNP junction passivated by glass and an outer surfaces thereof molded with glass. A breakover voltage thereof is 480 volts and a current in operation is 1 ampere in effective value. The diode 7 has a silicon PN junction passivated by glass and an outer surfaces thereof molded with glass. It has a reverse breakdown voltage of 600 volts and a forward current of 1.1 amperes. The ceramic capacitor was prepared in the following manner. Powder mixture of barium titanate ($BaTiO_3$), strontium titanate ($SrTiO_3$) and barium zirconate ($BaZrO_3$) was pressed into a disc having a diameter of 30 mm and a thickness of 0.5 mm and it was fired at 1400° C. for two hours. The diameter after firing was 25.5 mm. Silver film electrodes having a diameter of 23 mm were applied thereto by baking at 750° C., and lead wires were silver-soldered to the electrodes. The assembly was overcoated with glass powders having a thermal expansion coefficient of $90\times10^{-7}$/°C. and it was fired. The static capacitance of the capacitor used was 0.1 μF. The above circuit components were wired as shown in FIG. 11 and they were accommodated in the outer bulb 8 which was essentially evacuated. The discharge lamp was used with a high power factor stabilizer having a choke coil for a 400 W high pressure mercury lamp and a capacitor for improving a power factor. The discharge lamp was instantly started at the power supply voltage of 180 volts, and the thermo-sensitive switch was operated within three minutes after the start to isolate the starting circuit. As a lifetime test, the discharge lamp was mounted in a projector and left for 10,000 hours with a cycle of turn-on for 11 hours and turn-off for one hour. No abnormal condition was observed.

The high pressure metal vapor discharge lamp of the present invention offers the following advantages.

First, it does not utilize the mechanical switch such as thermo-sensitive switch to generate the high voltage pulses but utilizes the charge and the discharge of the ceramic capacitor. Accordingly, the magnitude of the high voltage pulses and the pulse interval are very stable and hence the stable starting characteristic is attained.

Secondly, since unduly high voltage pulses are not generated, the abnormal pulse absorbing circuit need not be incorporated. Accordingly, the assembling work is not complex and the economic discharge lamp is provided.

Thirdly, since the resistor of the starting circuit does not use the tungsten filament, the incorporation of the circuit into the discharge lamp is simple and the circuit has excellent anti-vibration property.

Fourthly, since the capacitor of the starting circuit is the ceramic capacitor, a sufficiently high voltage pulses to start the discharge lamp can be generated by making use of the voltage-charge characteristic of the ceramic capacitor.

Fifthly, since the components of the starting circuit are accommodated in the outer bulb, the assembly is compact and easy to handle. In order to assemble all of the components of the starting circuit into the discharge lamp, at least the ceramic capacitor must be connected in series with the semiconductor switching device. If the capacitor is connected directly in parallel to the light emitting tube, the high voltage pulses necessary to start the discharge lamp are not generated, and the diameter of the capacitor should be very large in order to attain a high coupling efficiency under the commercial power supply frequency. As a result, the size becomes very large, which makes the incorporation into the discharge lamp impossible.

Sixthly, since the outer surfaces of the ceramic capacitor and the semiconductor switching device of the starting circuit are overcoated with the glass material and the circuit is arranged in the vacuum or inert gas environment in the outer bulb through the thermo-sensitive switch, the heat resistivities of the respective components are sufficiently assured and the functions of those components in the high temperature environment are not deteriorated or lost.

The present invention, therefore, provides the practical high pressure metal vapor discharge lamp which self-contains the starting circuit, and it remarkably contributes to the industry.

We claim:

1. A high pressure metal vapor discharge lamp comprising:

a starting circuit connected in parallel with a light emitting tube having at least one pair of main electrodes;

said starting circuit including a serial circuit of at least;

(i) a thermo-sensitive switch which is closed at a room temperature and opened at a high temperature, (ii) a voltage-sensitive semiconductor switching device surrounded by a glass material, and (iii) a ceramic capacitor surrounded by a glass material and exhibiting a non-linear voltage charge characteristic, said starting circuit and said light emitting tube being accommodated in an outer bulb having an appropriate amount of inert gas filled therein or essentially evacuated; and said starting circuit being connected to an AC power supply through an inductive stabilizer.

2. A high pressure metal vapor discharge lamp according to claim 1, wherein a diode surrounded by a glass material is connected in parallel to said semiconductor switching device of said starting circuit.

3. A high pressure metal vapor discharge lamp according to claim 1, wherein said ceramic capacitor of said starting circuit is essentially made of barium titanate ($BaTiO_3$), and an appropriate amount of barium zirconate ($BaZrO_3$) is added thereto to shift a Curier point and thus second transition point such that a specific dielectric constant of 5,000–20,000 is attained.

4. A high pressure metal vapor discharge lamp according to claim 2, wherein said ceramic capacitor of said starting circuit is essentially made of barium titanate ($BaTiO_3$), and an appropriate amount of barium zirconate ($BaZrO_3$) is added thereto to shift a Curier point and thus second transition point such that a specific dielectric constant of 5,000–20,000 is attained.

5. A high pressure metal vapor discharge lamp according to claim 1 wherein a resistor is connected in series with said serial circuit of said thermo-sensitive switch, said semiconductor switching device and said ceramic capacitor.

6. A high pressure metal vapor discharge lamp according to claim 2, wherein a resistor is connected in series with said serial circuit of said thermo-sensitive switch, the parallel circuit of said semiconductor switching device and said diode, and said ceramic capacitor.

7. A high pressure metal vapor discharge lamp according to claim 1, wherein an auxiliary electrode is provided adjacent to one of said pair of main electrodes of said light emitting tube, and a serial circuit of said semiconductor switching device and said ceramic capacitor is connected between said one main electrode and said auxiliary electrode directly or through a starting resistor.

8. A high pressure metal vapor discharge lamp according to claim 2, wherein an auxiliary electrode is provided adjacent to one of said pair of main electrodes of said light emitting tube, and a serial circuit of said semiconductor switching device and said ceramic capacitor is connected between said one main electrode and said auxiliary electrode directly or through a starting resistor.

9. A high pressure metal vapor discharge lamp according to claim 4, wherein an auxiliary electrode is provided adjacent to one of said pair of main electrodes of said light emitting tube, and a serial circuit of said semiconductor switching device and said ceramic capacitor is connected between said one main electrode and said auxiliary electrode directly or through a starting resistor.

10. A high pressure metal vapor discharge lamp according to claim 1, wherein an auxiliary electrode is provided adjacent to one of said pair of main electrodes of said light emitting tube, and a serial circuit of the parallel circuit of said semiconductor switching device and said diode, and said ceramic capacitor is connected between said one main electrode and said auxiliary electrode.

11. A high pressure metal vapor discharge lamp according to claim 2, wherein an auxiliary electrode is provided adjacent to one of said pair of main electrodes of said light emitting tube, and a serial circuit of the parallel circuit of said semiconductor switching device and said diode, and said ceramic capacitor is connected between said one main electrode and said auxiliary electrode.

12. A high pressure metal vapor discharge lamp according to claim 4, wherein an auxiliary electrode is provided adjacent to one of said pair of main electrodes of said light emitting tube, and a serial circuit of the parallel circuit of said semiconductor switching device and said diode, and said ceramic capacitor is connected between said one main electrode and said auxiliary electrode.

13. A high pressure metal vapor discharge lamp according to claim 7, wherein said light emitting tube is made of quartz glass, and mercury, starting gas, several appropriate light emitting metals and halogen or a compound thereof are filled in said light emitting tube.

14. A high pressure metal vapor discharge lamp according to claim 8, wherein said light emitting tube is made of quartz glass, and mercury, starting gas, several appropriate light emitting metals and halogen or a compound thereof are filled in said light emitting tube.

15. A high pressure metal vapor discharge lamp according to claim 9, wherein said light emitting tube is made of quartz glass, and mercury, starting gas, several appropriate light emitting metals and halogen or a compound thereof are filled in said light emitting tube.

16. A high pressure metal vapor discharge lamp according to claim 10, wherein said light emitting tube is made of quartz glass, and mercury, starting gas, several appropriate light emitting metals and halogen or a compound thereof are filled in said light emitting tube.

17. A high pressure metal vapor discharge lamp according to claim 11, wherein said light emitting tube is made of quartz glass, and mercury, starting gas, several appropriate light emitting metals and halogen or a compound thereof are filled in said light emitting tube.

18. A high pressure metal vapor discharge lamp according to claim 12, wherein said light emitting tube is made of quartz glass, and mercury, starting gas, several appropriate light emitting metals and halogen or a compound thereof are filled in said light emitting tube.

19. A high pressure metal vapor discharge lamp according to claim 2, wherein a resistor for adjusting a pulse interval is connected in series with said diode of said starting circuit to form a serial circuit, and said serial circuit is connected in parallel to said semiconductor switching device.

20. A high pressure metal vapor discharge lamp according to claim 2, wherein a proximity conductor for assisting start of said discharge lamp is mounted on an outer wall of said light emitting tube, and in starting said discharge lamp, said proximity conductor is kept at the same potential as that of one of said pair of main electrodes and a counterelectrode voltage is applied to the other main electrode.

21. A high pressure metal vapor discharge lamp according to claim 19, wherein a proximity conductor for assisting start of said discharge lamp is mounted on an outer wall of said light emitting tube, and in starting said discharge lamp, said proximity conductor is kept at the same potential as that of one of said pair of main electrodes and a counterelectrode voltage is applied to the other main electrode.

22. A high pressure metal vapor discharge lamp according to claim 20, wherein said counterelectrode potential applied to said other main electrode of said light emitting tube at the start of said discharge lamp is removed by moving said proximity conductor away from said outer wall of said light emitting tube or cutting off a circuit for applying the potential to said proximity conductor, after the start of said discharge lamp.

23. A high pressure metal vapor discharge lamp according to claim 21, wherein said counterelectrode potential applied to said other main electrode of said light emitting tube at the start of said discharge lamp is removed by moving said proximity conductor away from said outer wall of said light emitting tube or cutting off a circuit for applying the potential to said proximity conductor, after the start of said discharge lamp.

24. A high pressure metal vapor discharge lamp according to claim 23, wherein means for applying or removing the counterelectrode potential to or from said other main electrode of said light emitting tube is shared with or linked to said thermo-sensitive switch of said starting circuit to prevent said starting circuit from being operated until the counterelectrode potential is applied to said other main electrode.

25. A high pressure metal vapor discharge lamp according to claim 20, wherein said light emitting tube is made of light-transmissive ceramic, and alkaline metal and/or other light emitting metal, starting gas and buffering gas source are filled in said light emitting tube.

26. A high pressure metal vapor discharge lamp according to claim 21, wherein said light emitting tube is made of light-transmissive ceramic, and alkaline metal and/or other light emitting metal, starting gas and buffering gas source are filled in said light emitting tube.

27. A high pressure metal vapor discharge lamp according to claim 23, wherein said light emitting tube is made of light-transmissive ceramic, and alkaline metal and/or other light emitting metal, starting gas and buffering gas source are filled in said light emitting tube.

28. A high pressure metal vapor discharge lamp according to claim 24, wherein said light emitting tube is made of light-transmissive ceramic, and alkaline metal and/or other light emitting metal, starting gas and buffering gas source are filled in said light emitting tube.

* * * * *